US005199196A

United States Patent [19]

Straley

[11] Patent Number: 5,199,196

[45] Date of Patent: Apr. 6, 1993

[54] EARTH GRADING AND SOIL COMPACTION TRACTOR WITH WATER SPRAY CAPABILITY

[76] Inventor: Paul M. Straley, 1635 Fire Hollow, Diamond Bar, Calif. 91765

[21] Appl. No.: 899,280

[22] Filed: Jun. 16, 1992

[51] Int. Cl.[5] ..... E02F 3/00

[52] U.S. Cl. ..... 37/442; 37/403; 111/118; 239/172; 239/289; 239/722

[58] Field of Search ..... 37/118 A, 227, 228, 37/117.5, 71; 239/172, 289, 722; 111/118

[56] References Cited

U.S. PATENT DOCUMENTS

| | | | |
|---|---|---|---|
| 641,594 | 1/1900 | Hartwich | 239/289 |
| 1,369,970 | 3/1921 | Fuller | 111/118 |
| 3,016,201 | 1/1962 | Brogden | 239/172 X |
| 3,425,368 | 2/1969 | Haynes | 111/118 |
| 4,597,203 | 7/1986 | Middleton | 239/289 X |

FOREIGN PATENT DOCUMENTS

| | | | |
|---|---|---|---|
| 4007470 | 3/1991 | Fed. Rep. of Germany | 37/1 |
| 76292 | 6/1981 | Japan | 37/1 |
| 881213 | 11/1981 | U.S.S.R. | 37/117.5 |

*Primary Examiner*—David H. Corbin
*Assistant Examiner*—Arlen L. Olsen
*Attorney, Agent, or Firm*—Edgar W. Averill, Jr.

[57] ABSTRACT

An improved tractor for earth grading and soil compaction having a hydraulically operated bucket mounted on the front and including a water tank and water spray nozzle. The water spray nozzle is positioned on the bucket so that it can add water to soil as it is moved by the bucket and also can be raised and aimed by the tractor operator. This permits the tractor operator to use the water spray to wet down a load of soil in a truck.

11 Claims, 3 Drawing Sheets

FIG. 5
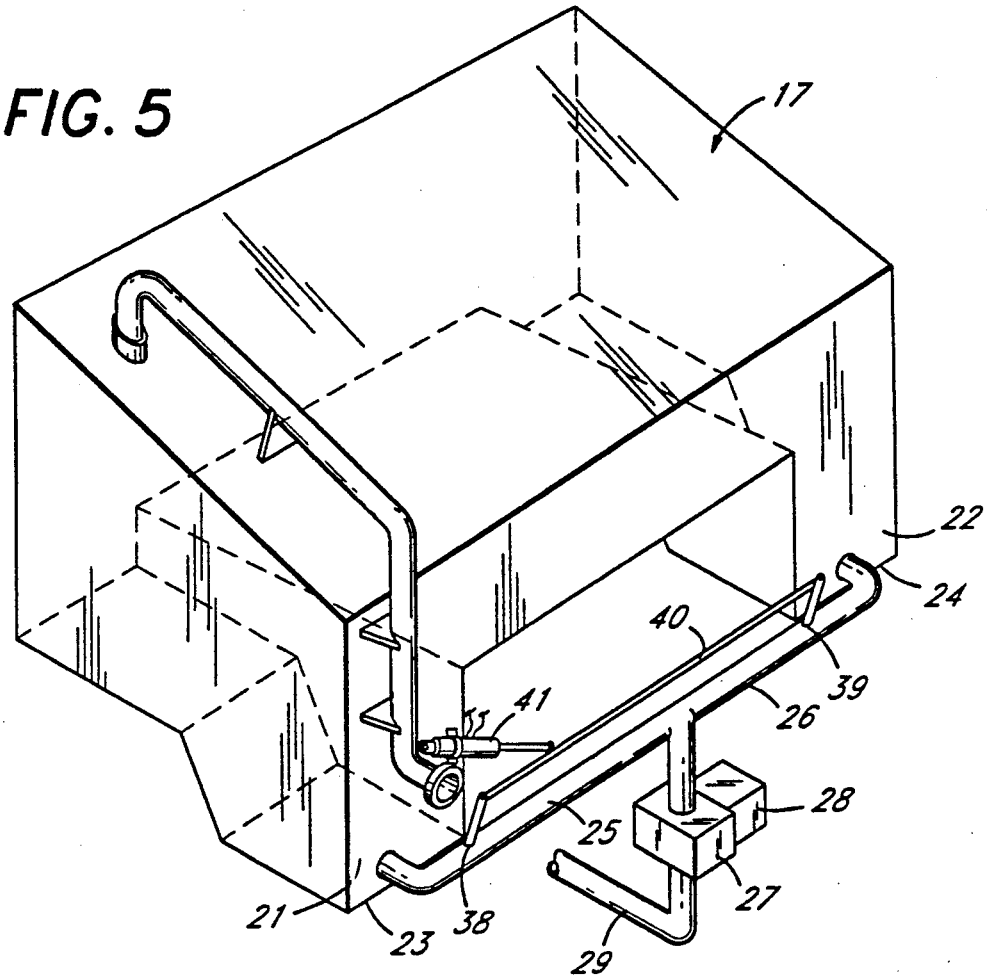
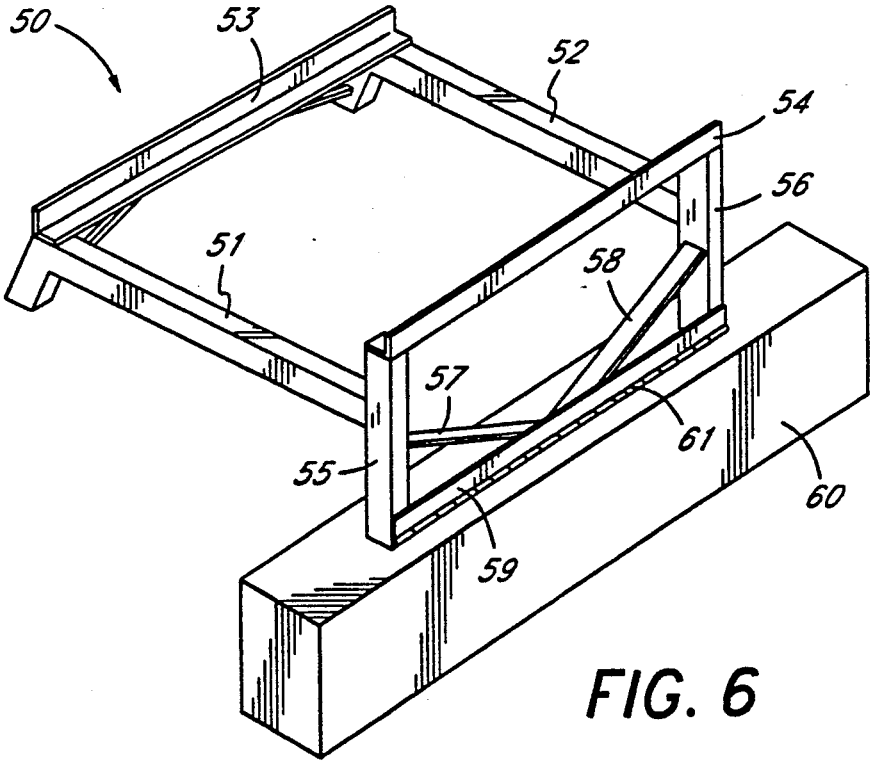
FIG. 6

EARTH GRADING AND SOIL COMPACTION TRACTOR WITH WATER SPRAY CAPABILITY

BACKGROUND OF THE INVENTION

The field of the invention is earth grading and soil compaction, and the invention relates more particularly to tractors and other off-road equipment used for moving and compacting soil in preparation for construction.

Soil compaction is the process of physically densifying or packing the soil so that the soil is capable of supporting increased weight. It is generally accepted that the strength of a soil can be increased by densification, and three important factors affect compaction. These are material gradation, moisture content and compactive effort. Material gradation refers to the distribution o different particle sizes within a soil sample. A soil sample having particles of all one size would be said to be poorly graded. Such poorly graded soil cannot be effectively compacted. If, instead, the soil particles are of many different sizes, it will compact more easily since the smaller particles tend to fill the empty spaces between the larger particles leaving fewer voids after compaction.

Another important factor affecting soil compaction is moisture content. Water lubricates soil particles thus helping them slide into the most dense position Water also creates clay particle bonding giving cohesive materials their sticky qualities. It is very difficult, if not impossible, to achieve proper compaction in materials that are too dry or too wet. Soil experts have determined that in practically every soil there is an amount of water called the optimum moisture content at which it is possible to obtain maximum density with a given amount of compactive effort.

The last factor is compactive effort which may be from static weight or pressure from a kneading action, impact or vibration.

In large-scale earth moving projects, different pieces of equipment are utilized for the steps of mixing the soil to provide proper material gradation, for adding water and for compacting. For smaller projects, such large-scale equipment is too expensive and too unwieldy. For instance, the conversion of a former filling station lot to a strip center would not provide space to utilize the above-referenced large-scale equipment. Thus, smaller pieces of equipment such as a wheel loader is commonly used. A wheel loader has a front-mounted bucket which may be used to mix the soil to improve the gradation of the soil materials. Typically, in order to provide sufficient moisture contact, a worker with a garden or fire hose will wet the surface of the lot to be graded and will periodically add water as directed. The wheels of the loader will then be used for compaction together with the bucket for mixing and grading to provide a satisfactory degree of material gradation, moisture content and compactive effort.

It is inefficient, however, for a separate workman to simply operate a garden or fire hose for watering, and also the water is not evenly mixed in the soil when it is initially sprayed on the surface. Furthermore, the weight of the loader's wheels are often insufficient to provide the optimum in compaction. There is, thus, a need for a more efficient and more effective vehicle for grading, adding moisture and compacting soil.

SUMMARY OF THE INVENTION

It is an object of the present invention to provide an improved tractor for earth grading and soil compaction which also adds water to the soil to be graded and compacted further increasing the weight on the wheels of the tractor for increased compaction while eliminating the need for a separate worker for adding water to the surface of the soil.

The present invention is for an improved tractor for earth grading and soil compaction of the type having a hydraulically operated bucket mounted on the front. The tractor has a water tank mounted behind the cab, and a pump directs water through an outlet hose to a nozzle affixed to the top of the bucket. The nozzle is positioned in a manner so that as the soil moves from the base along the back and out the top of the bucket, it is impacted by a spray of water from the nozzle thereby adding moisture in an optimum manner. The water tank is preferably in the shape of an inverted "U," and the water line directing water from the tank to the nozzle is preferably flexible so that the nozzle can be moved with the bucket to enable the operator to direct the water spray by manipulating the bucket.

BRIEF DESCRIPTION OF THE DRAWINGS

FIG. 5 is a perspective view showing the left side, top and rear of the v ater tank of the tractor of FIG. 1.

FIG. 6 is a perspective view showing the left side, rear and top of a frame used to hold the water tank on the tractor of FIG. 1.

DESCRIPTION OF THE PREFERRED EMBODIMENTS

Figure 1:
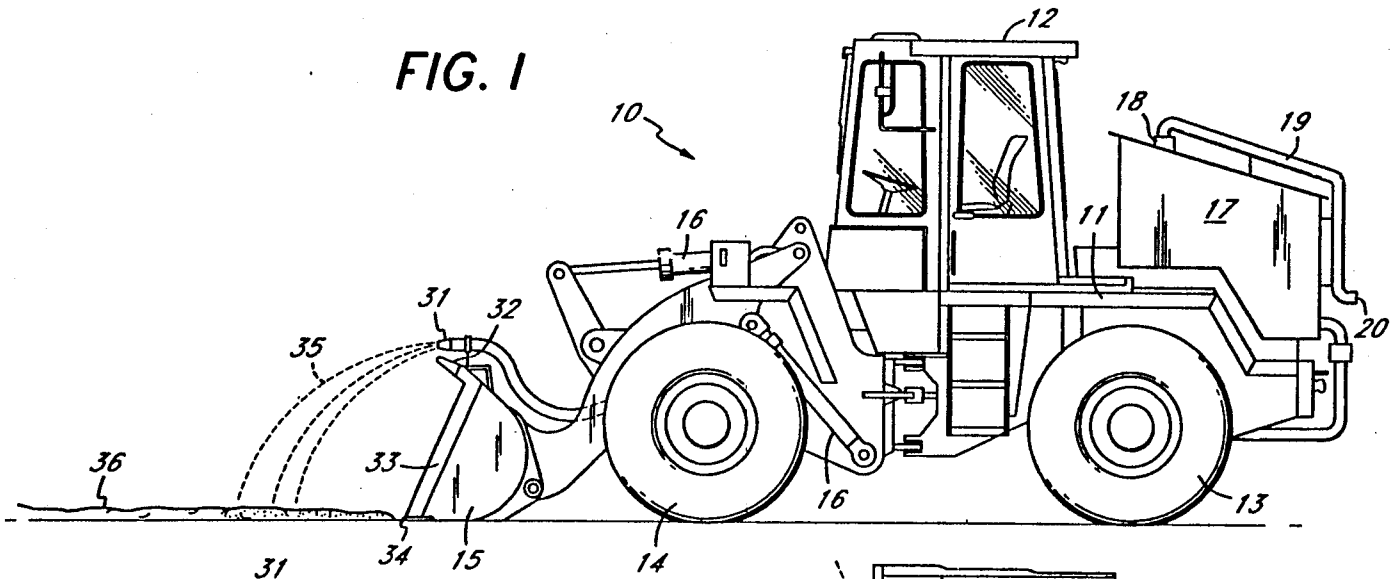
FIG. 1 is a side view of the improved tractor of the present invention.

The tractor of the present invention is shown in side view in FIG. 1 and indicated generally by reference character 10. Tractor 10 has a frame 11, a centrally located cab 12, a pair of rear wheels 13 and a pair of front wheels 14. A hydraulically operated bucket 15 may be lifted and tilted by hydraulic cylinders such as those indicated by reference character 16. These are connected through arms and links in a conventional manner to enable the operator in the cab to manipulate the bucket.

A water tank 17 is supported by the frame 11 of the tractor and has a filler opening 18 into which a filler pipe 19 is directed. Filler pipe 19 has an inlet 20 which preferably has a quick connect and disconnect fitting to enable the inlet to be connected to a source of water for filling tank 17. As shown best in FIG. 5, tank 17 is in the shape of an inverted "U" having a pair of downwardly depending arms 21 and 22, each of which have a base 23 and 24, respectively. A pair of water outlet pipes 25 and 26 provide an inlet for pump 27 which is preferably driven by a hydraulic motor 28 although electric or gasoline operated pumps can, of course, alternatively be used. Pump 27 has a discharge line 29 which is directed forward of the tractor and is positioned between the two rear wheels 13 and the two front wheels 14. Discharge line 29 may be either entirely made from a flexible material such as reinforced rubber or may be partly rigid with the end portion 30 being fabricated from a flexible material. A nozzle 31 is mounted on the top 32 of bucket 15. Bucket 15 has a pair of sides 33 and a bottom edge 34.

Figure 2:
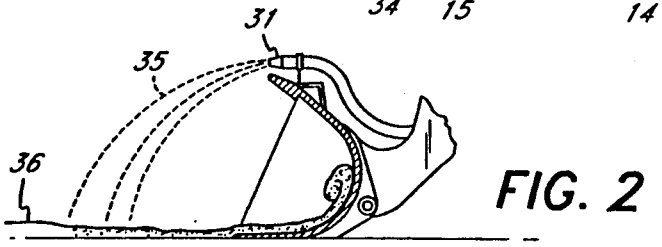
FIG. 2 is a cross-sectional view of the bucket and water nozzle of the tractor of FIG. 1.
Figure 3:
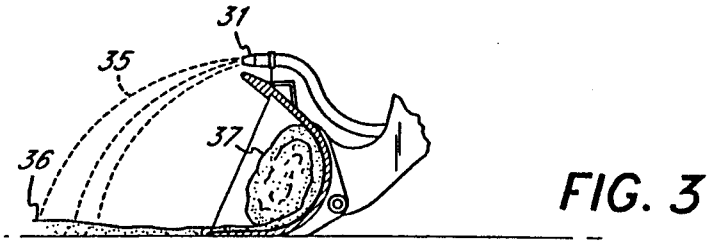
FIG. 3 is a cross-sectional view of the nozzle and bucket of the tractor of FIG. 1.
Figure 4:
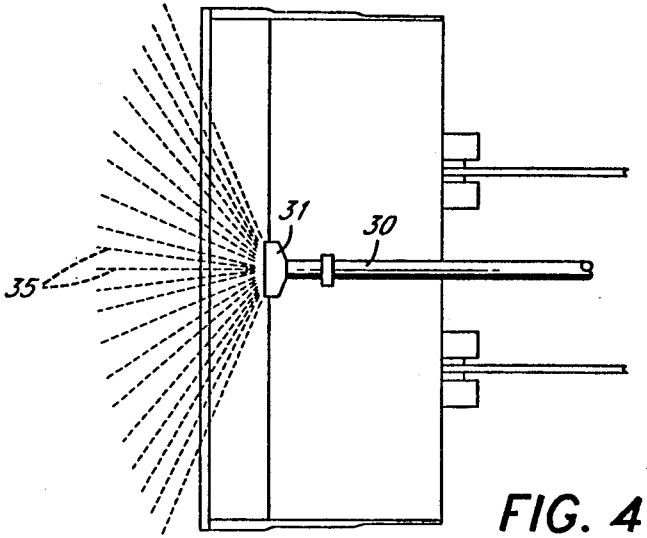
FIG. 4 is a top view of the nozzle and bucket of the tractor of FIG. 1.

Nozzle 31 directs a fan of water 35 outwardly and downwardly as shown in FIGS. 2, 3 and 4. The soil 36 is scooped up into the bucket, as indicated in FIG. 2, and as the tractor continues forward, the soil is moved upwardly in a circular fashion in the bucket as indicated by reference character 37 in FIG. 3. In this rolling and moving motion caused by the movement of the bucket along the surface of the soil, the water fan 35 is directed on the soil as it is being turned and rotated within bucket 15. This provides a unique moisture adding technique not heretofore possible. The water spray may be turned on and off as desired by the operator as set forth below.

As shown in FIG. 5, a pair of ball valves are located in outlet lines 25 and 26, and the valves are linked by an arm 40 which, in turn, is linked to a hydraulic or air cylinder 41 which can simultaneously turn on or off valves 38 and 39. The hydraulic or air fluid is controlled by the operator in the cab so that water may be added only as needed.

It is also evident from FIG. 1 that the water tank 17 is over the rear wheels 13 and subsonically adds to the weight exerted by the rear wheels. The water tank preferably has a capacity of about 500 gallons which can provide up to 4000 pounds of additional weight for compaction purposes.

Although one nozzle 31 is shown in the top of the bucket, of course more than one nozzle may be used.

One method for supporting tank 17 on tractor 10 is indicated in FIG. 6 where a frame 50 is first placed over the rear of the tractor. Frame 50 has a pair of side arms 51 and 52, a front cross member 53 and a rear cross member 54 affixed to vertical arms 55 and 56 which, in turn, ar braced by arms 57 and 58 to a bottom bar 59 which is affixed to a counterweight 60 by a hinge 61. After the frame 50 has been placed on he rear of the tractor, the empty water tank 17 is lowered onto the frame and is securely held in place by its own weight.

Figure 7:
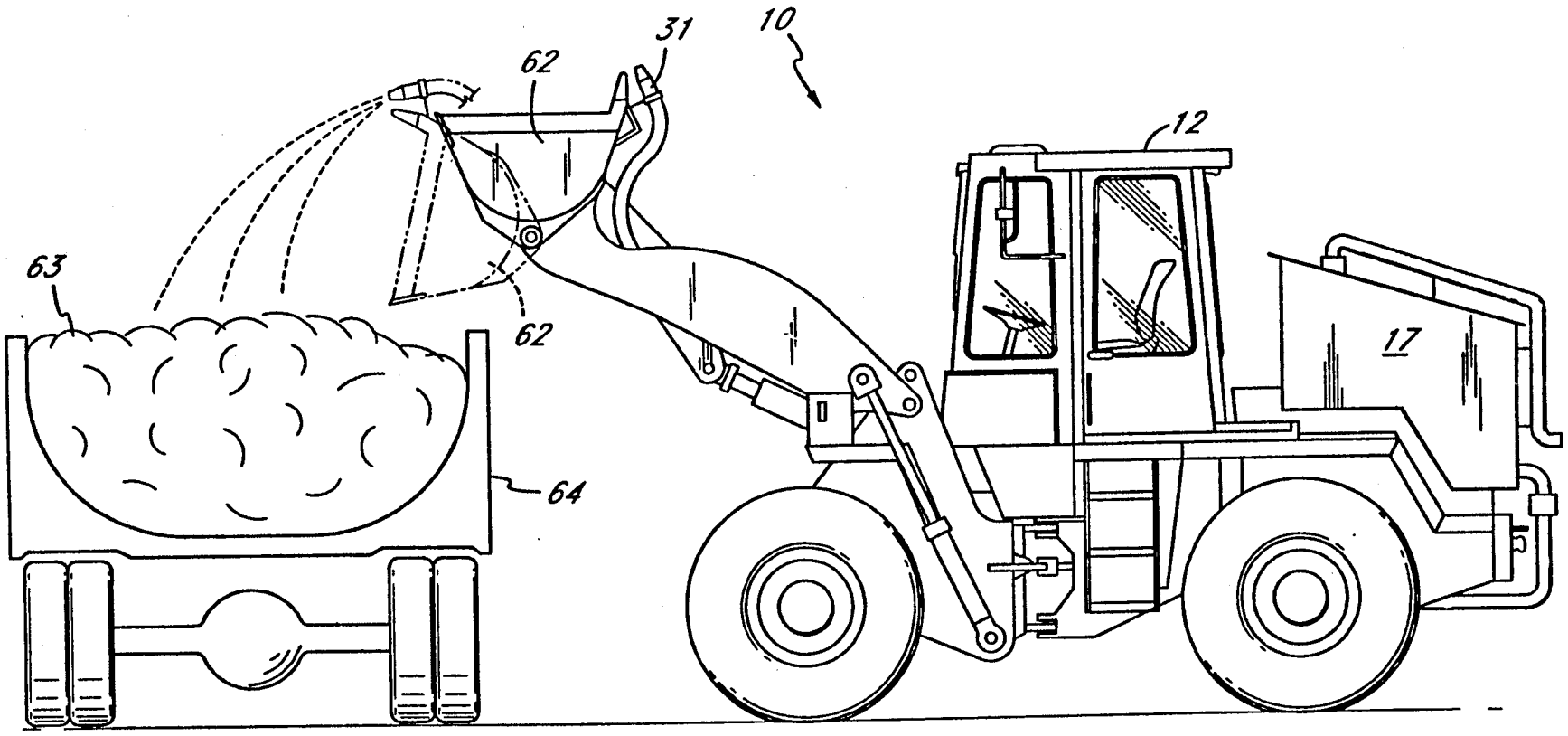
FIG. 7 is a side view of the tractor of FIG. 1 showing the bucket in several positions

Another important feature of the tractor of the present invention is depicted in FIG. 7 where it can be seen that as the bucket is raised to a position indicated by reference character 62 that the nozzle can spray water on the surface of a load of dirt 63 to help prevent soil from blowing out of the truck 64. It is also, of course, possible to use the water for other construction uses since the bucket is so highly maneuverable by the operator who can also turn on and off the water spray.

While the water tank and nozzle of the present invention is shown on a wheel loader, it can, of course, be used on other earth moving equipment such as dozers, motor graders, scrapers, track loaders, etc. While an inverted "U" shape tank is preferred for the style of tractor shown in FIG. 1, other shapes of tanks can be fabricated according to the particular tractor being used.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

What is claimed is:

1. An improved tractor for earth grading and soil compaction of the type having a tractor frame and body with a hydraulically operated bucket mounted on the front for moving soil and a centrally located cab and at least two front wheels and at least two rear wheels, wherein the improvement comprises:

a water tank supported by said tractor frame and positioned behind said cab, said water tank having a water tight interior volume;

a pump having an inlet from the interior of the tank and said pump having an outlet;

a water outlet hose connected at one end to the outlet of said pump and said outlet hose directing water forward of said tractor, said outlet hose having at least an end portion thereof fabricated from a flexible material, said end portion being positioned near the bucket of said tractor; and a nozzle affixed to said bucket and said nozzle being fed by said water outlet hose whereby when said water tank supplies water to said pump which, in turn, supplies water through said water outlet hose to said nozzle, the resulting water spray from said nozzle can be directed by an operator of said tractor to the soil which is being moved by said bucket to result in a mixed combination of soil and water of a predetermined and desired moisture content for compaction and wherein the water in said tank increases the weight on said wheels to further increase the soil compaction by said tractor.

2. The improved tractor for earth grading and soil compaction of claim 1 wherein said bucket has a top edge, two side edges and a bottom edge, and said nozzle is supported by the top edge of said bucket.

3. The improved tractor for earth grading and soil compaction of claim 2 wherein said portion of said hose which is fabricated from flexible material is sufficient in length to permit the bucket to be raised to its maximum height and still be able to conduct water to said nozzle.

4. The improved tractor for earth grading and soil compaction of claim 1 wherein said water tank is in the shape of an inverted "U", each arm of said inverted "U" having a base.

5. The improved tractor for earth grading and soil compaction of claim 4 wherein there are a pair of outlet lines, one from each base of said inverted "U," and each outlet line has a shut-off valve.

6. The improved tractor for earth grading and soil compaction of claim 5 wherein the shut-off valve in each outlet line from each base is linked together to be turned on or off simultaneously.

7. The improved tractor for earth grading and soil compaction of claim 1 wherein said pump is a hydraulically driven pump.

8. An improved tractor for earth grading and soil compaction of the type having a tractor frame and body with a hydraulically operated bucket having a top, two sides and a bottom, said bucket being mounted on the front for moving soil, and a centrally located cab, and at least two front wheels, and at least two rear wheels, wherein the improvement comprises:

an inverted "U" shaped water tank supported by said tractor frame and positioned behind said cab, said water tank having a watertight interior volume and each of the arms of said inverted "U" shaped water tank has a base;

a pump having a pair of inlets, one from each base of said arms of said tank, said pump having an outlet;

a water outlet hose connected at one end to the outlet of said pump, and said outlet hose directing water forward of said tractor, said outlet hose having at least an end portion thereof fabricated from a flexible material, said end portion being positioned near the bucket of said tractor; and a nozzle affixed to the top of said bucket, and said nozzle being fed by said water outlet hose whereby when said water tank supplies water to said pump which, in turn, supplies water through said water outlet hose to said nozzle, the resulting water spray from said nozzle can be directed by an operator of said tractor to the soil which is being moved by said bucket to result in a mixed combination of soil and water of a predetermined and desired moisture content for compaction and wherein the water in said tank increases the weight on said wheels to further increase the soil compaction by said tractor.

9. The improved tractor for earth grading and soil compaction of claim 8 wherein said outlet hose is located between the two front wheels and the two rear wheels.

10. The improved tractor for earth grading and soil compaction of claim 9 wherein the entire length of said outlet hose is fabricated from reinforced rubber.

11. The improved tractor for earth grading and soil compaction of claim 8 wherein said inverted "U" shaped tank is supported on a separate removable tank frame on said tractor.

* * * * *